US005228682A

United States Patent [19]

Wolf

[11] Patent Number: 5,228,682

[45] Date of Patent: * Jul. 20, 1993

[54] SHOOTING AND TRAINING AID FOR BASKETBALL PLAYERS

[76] Inventor: Jay Wolf, 2205 6th St., Marinette, Wis. 54143

[ * ] Notice: The portion of the term of this patent subsequent to Apr. 24, 2007 has been disclaimed.

[21] Appl. No.: 644,015

[22] Filed: Jan. 22, 1991

[51] Int. Cl.[5] ..... A63B 69/00

[52] U.S. Cl. ..... 273/1.5 A; 273/54 B

[58] Field of Search ..... 273/1.5 A, 54 B, 189 RA; 128/77, 169, 876, 878

[56] References Cited

U.S. PATENT DOCUMENTS

| | | | |
|---|---|---|---|
| 2,180,270 | 11/1939 | Anderson, Jr. | 128/878 X |
| 3,858,881 | 1/1975 | Hurwitz | 273/29 R X |
| 4,778,033 | 10/1988 | Gonzalez et al. | 128/878 X |
| 4,905,713 | 3/1990 | Morante | 128/878 X |
| 4,919,425 | 4/1990 | Wolf | 273/1.5 A |

FOREIGN PATENT DOCUMENTS

| | | | |
|---|---|---|---|
| 7994 | of 1886 | United Kingdom | 128/876 |

*Primary Examiner*—Paul E. Shapiro

*Attorney, Agent, or Firm*—Hoffman, Wasson & Gitler

[57] ABSTRACT

A training and shooting aid for basketball players to eliminate and prevent interference by the guide arm and guide hand when shooting a basketball. The training and shooting aid includes an adjustable band adapted to encircle a player's guide arm. The band is intended to be snugly secured around the player's arm slightly above the elbow. A non-stretchable separable strap member has a free end adapted to be associated with the band member. The opposite end of the strap member is provided with a loop for placing around the thumb of the player's guide hand. Once the loop has been placed around the player's thumb, the strap member is adapted to be tightened, whereby the guide hand and thumb are pulled toward the elbow.

15 Claims, 1 Drawing Sheet

SHOOTING AND TRAINING AID FOR BASKETBALL PLAYERS

CROSS-REFERENCES

This application is related to U.S. Pat. No. 4,919,425 that was filed on Apr. 24, 1989 as U.S. application Ser. No. 07/342,093 and issued on Apr. 24, 1990 to Jay Wolf.

FIELD OF THE INVENTION

The invention pertains generally to a shooting and training aid for basketball players. More particularly, the invention relates to a shooting and training aid which is adapted to be worn by a basketball player for the purpose of developing a proper basketball shot and for increasing shooting percentages.

The invention addresses the problem of training novice basketball players in acquiring an efficient shooting technique. The relatively unskilled player tends to utilize both arms in propelling the ball to the basket. The latter tendency, wherein both the guide arm and the shooting arm are relied upon to project the ball, results in interference between the action of both arms. Because one arm usually dominates the other arm, it is difficult, if not impossible, to coordinate the shooting action between both arms, and the ball thus shot will follow an undesirable trajectory. If, however, the power for propelling the basketball toward the basket is provided only by the shooting arm and hand, with the guide arm and hand serving merely to guide the ball to the point of release, the proper ball trajectory is apt to ensue. Therefore, it is necessary to eliminate the common habit of novice players to utilize the guide arm and guide hand to assist in projecting the ball during the shot process if the correct shooting technique is to be attained.

Another common tendency frequently observed in the shooting action of young players is that of relying upon the thumb of the guide hand to assist in propelling the basketball. As was discussed above in connection with utilization of the guide arm, utilization of the thumb of the guide hand similarly interferes with the direction of the force that is generated by the dominant shooting hand and thereby negatively influences the trajectory followed by the basketball. Moreover, the thumb of the guide hand tends to impart an undesirable side spin motion to the ball, which also negatively affects the path of the basketball and gives rise to shooting inaccuracies.

Thus, the need exists for a basketball shooting and training aid which assists a player in acquiring the proper shooting technique by preventing the guide arm and hand from interfering with the action provided by the shooting arm and hand. The need further exists for a basketball shooting and training aid which prevents the thumb of the guide hand from being used to propel the basketball.

The present invention satisfies the foregoing needs by providing a shooting and training aid for basketball players which effectively eliminates the guide hand interference habit resulting from the use of the guide arm and guide hand during the shooting process. The invention accomplishes the preceding objectives by providing a device which possesses the additional attributes of being wearable on the guide arm of a player, being adaptable to a right or left handed player, being susceptible of ready and easy assembly upon the arm of a player, being adjustable for various arm sizes, being safe, and being capable of being worn for any type of shot, either a set shot or a jump shot.

The present invention is characterized by a further advantage, in that it does not prevent or discourage important beneficial uses of the guide arm and hand. For instance, the invention still allows the guide hand to be used to catch the ball and to "feel" the ball. The latter feature is particularly important because good shooting technique requires that the guide hand be utilized during the initial stage of a shot to position and guide the ball. Thus, once the guide hand interference habit has been overcome, the player must be able to utilize the guide hand in the proper manner. The present invention overcomes the guide hand interference habit while simultaneously permitting the acquisition of desirable habits for the guide arm and hand.

DESCRIPTION OF THE PRIOR ART

Training and shooting aids for basketball are generally known in the prior art. Such devices, however, are typically directed to the shooting arm, and are often complex and cumbersome. For example, U.S. Pat. No. 4,383,685, which issued on May 17, 1983 to Bishop, discloses a training aid for basketball players including a vest to be worn by the player and a curved guide bar pivotally mounted on the vest. An elastic sleeve worn on the elbow of the player's shooting arm is provided with a carriage that moves along the guide bar to direct the player's shooting arm in a curved path for proper shooting the basketball.

U.S. Pat. No. 3,820,783, which issued to Caveness on Jun. 28, 1974, teaches a basketball training aid which is intended to indicate the proper height to which the player's elbow should be raised in the shooting process. Caveness shows a belt-supported bracket having an upwardly and forwardly extending arm provided at its upper end with a transverse gage bar which indicates the preferred height to which the player's elbow should be elevated. A guide bar which depends from the gage bar indicates the preferred lateral position for the player's elbow. The components of the device are relatively adjustable.

Although it is known in the prior art to provide means for discouraging use of the guide arm and hand in teaching the proper methods for shooting baskets, such is done so only in an indirect manner. For instance, U.S. Pat. No. 4,377,284, which issued to Okerlin on Mar. 22, 1983, is directed to a basketball training device which inhibits utilization of both arms while shooting, by restricting movement of the player's elbows. The device maintains the player's elbows in close proximity to each other as the ball is cast toward the basket. The device comprises a pair of stretchable sleeves adapted to be worn over the forearms of the guide and shooting arms adjacent the player's elbow. The sleeves are interconnected by means of a stretchable member which resists parting movement of the elbows.

Similarly, U.S. Pat. No. 4,579,341 to Furr, dated Apr. 1, 1986, restrains the elbow of a player's shooting arm by means of an L-shaped arm guide member connected to a support member which is secured to the back of a body harness worn around the torso of a player.

The prior art also generally teaches a variety of means for proper placement of a player's hands upon a basketball. U.S. Pat. No. 3,707,730 to Slider, for example, which issued on Jan. 2, 1973, discloses a basketball practice glove including thumb and finger portions, and palm, back and wrist portions. The palm portion spaces the player's palm from the basketball, while an adjustable strap between the thumb and index finger portions limits the extent to which the latter fingers can be separated. A stay provided on the back portion limits bending movement of the player's wrist. The glove is intended to cause the player's shooting hand to assume a cup-like shape so that the ball is controlled by the tips of the thumb and the fingers.

U.S. Pat. No. 3,640,532 to Bauer, which issued on Feb. 8, 1972, comprises an elongated flexible tube secured to the palm of a player's hand by means of elastic loop for the purpose of preventing the basketball form touching the palm. Auxiliary straps extending between the fingers of the player's hand keep them separated for proper handling of the ball.

In addition, U.S. Pat. No. 3,858,876, which issued to Williams on Jan. 7, 1975, teaches providing a basketball with visible and/or tactile markings, recessed lines, areas, etc. corresponding to the correct placement of the hands and fingers upon the basketball.

Finally, Morse, in U.S. Pat. No. 3,880,426, that issued on Apr. 29, 1975, discloses a wrist and finger support for bowling. The device includes a band for wrapping around the wrist to support a pair of palm straps and also to provide support for the wrist. The palm straps include a resilient portion and finger stalls. The finger stalls are intended to engage the fingers while palm straps properly position the user's hand.

The prior art neither teaches nor suggests a training and shooting aid intended to be worn only upon the guide arm and hand for preventing interference by the guide arm due to inward rotation of the guide hand and thumb during the process of shooting a basketball.

The inventor of the shooting and training aid disclosed in this application previously patented a similar aid in U.S. Pat. No. 4,919,425, which issued on Apr. 24, 1990. The earlier device included a pair of band members encircling the player's guide arm adjacent the elbow, a thumb engaging loop and a strap adjustably connecting the thumb-engaging loop and the band members. The instant invention has expanded upon the earlier idea by providing a single band adapted to be secured above the elbow of the player's guide arm and by replacing the VELCRO (i.e. hook and loop) securing structure of the earlier device with fastening rings.

SUMMARY OF THE INVENTION

The invention relates to a training and shooting aid for basketball players adapted to be worn upon the guide arm of a player and comprising a first adjustable non-stretchable band member, which is adapted to encircle the player's guide arm slightly above the elbow. The band member has one end stitched over in a loop to secure a pair of fastening rings in place, while the other end is free to be passed through the fastening rings for receiving the ends together around the wearer's arm in an adjustable fashion.

A strip member is secured to the band member at a location along the length of the band member by means of permanent stitching or the like. A pair of "D" rings, preferably fabricated of metal, are anchored to the free end of the strap member. The invention further comprises a separable second strap member, fabricated from non-stretchable material and having a first free end and a second end terminating in a loop.

The training and shooting aid is intended to be utilized by a player placing the band member upon his guide arm slightly above the elbow. The ends of the band member are secured together by passing the free end of the band member through the fastening rings, in a well known manner, so that the band member snugly, yet comfortably, encircles the player's arm. The loop of the second strap member is placed over the thumb of the player's guide hand, and the strap is diagonally crossed over the top of the arm to the outer portion thereof, proximate the elbow, whereupon the free end of the strap is threaded through the "D" rings. The free end of the strap projecting through the rings is pulled upon so as to draw the guide hand and the thumb upward and outward toward the elbow.

The invention prevents the guide hand form rotating inwardly toward the basketball, thereby preventing the guide hand from applying a propulsive force to the ball. Moreover, the invention causes the thumb to be pulled toward the elbow, and therefore prohibits the thumb of the guide hand from contributing to projection of the basketball. The invention thus eliminates the common problem of guide hand interference, resulting in an unimpeded trajectory for the ball and higher shooting percentages.

DESCRIPTION OF THE PREFERRED EMBODIMENT

Figure 1:
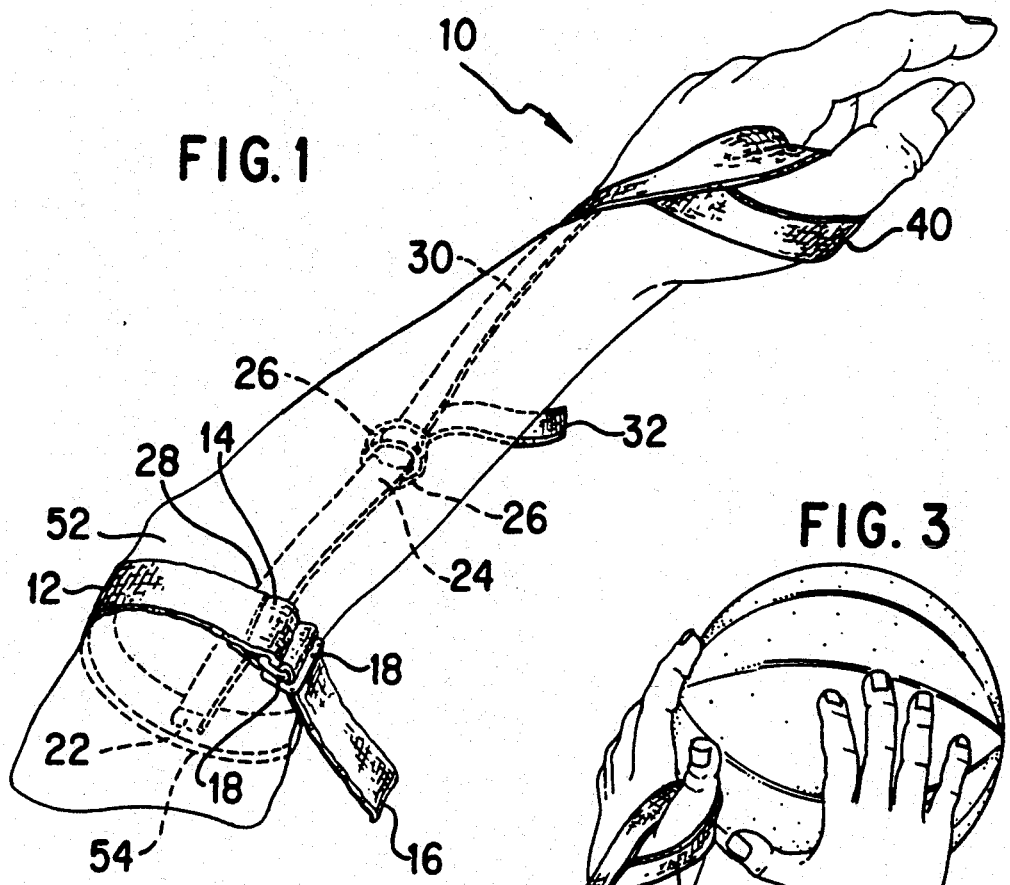
FIG. 1 shows a perspective view of the training and shooting aid as it appears when assembled upon the guide arm and hand of a basketball player.
Figure 2:
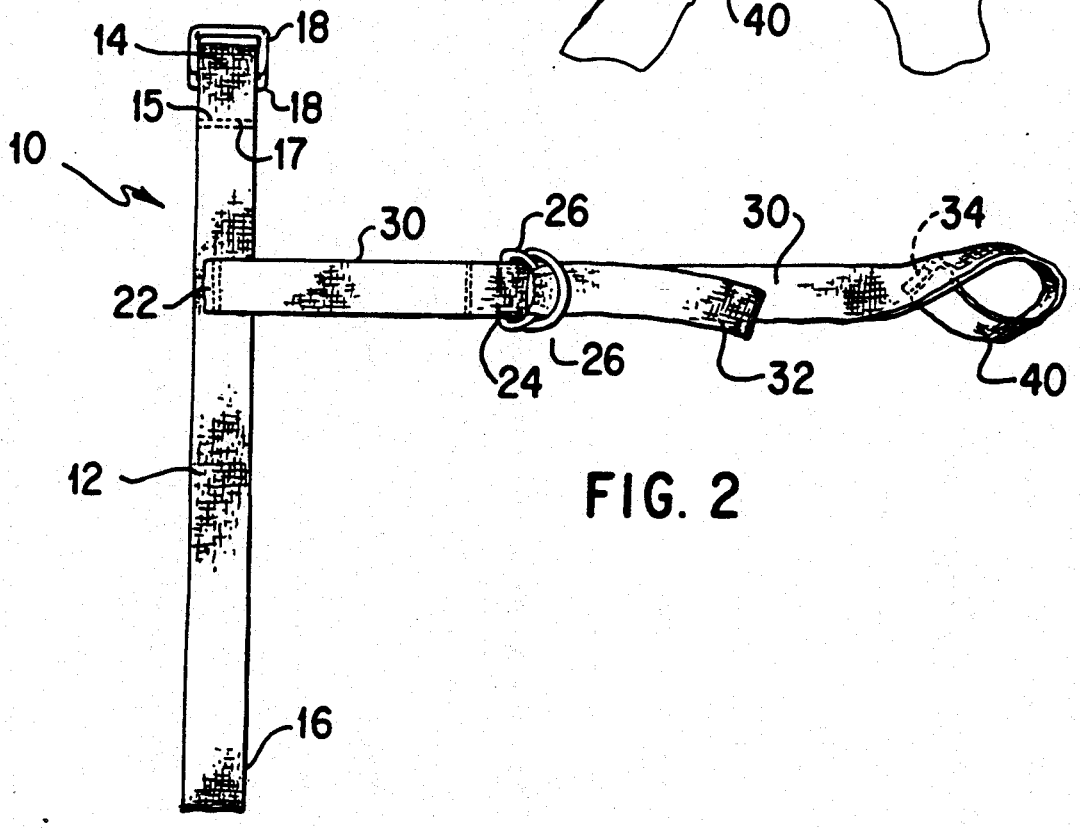
FIG. 2 is a plan view of the training and shooting aid.

With reference to the drawings, the training and shooting aid of the present invention, as indicated generally at 10 in FIGS. 1 and 2, includes a band member 12. The band member 12 is fabricated of non-stretchable material, preferably one inch width cloth material, and has first and second ends 14 and 16, respectively. The length of the band member 12, as measured from the first end to the second end, is sufficient to allow the band member 12 to be snugly assembled around the arm of a basketball player, above the elbow, as depicted in FIG. 1.

The band member 12 is intended to be maintained in position around the wearer's arm by a securing means provided on the first and/or second ends of the band member. As illustrated in FIGS. 1 and 2, a preferred form for the securing means is a pair of fastening rings 18 secured to the first end 14 of the band member 12 through which the second end 16 may be passed to secure the band member 12 in a closed loop configuration. Although this is the preferred embodiment, it is to be understood, of course, that other suitable securing means may be substituted for the fastening rings 18 illustrated herein for securing the first end 14 of the band member 12 to the second end 16 of the band member 12 around the arm of a player. Other securing means may include hook and loop type fasteners (VELCRO), tying of the ends, buckles, snaps or any other securing means considered suitable.

As shown in FIG. 2, the rings 18 are secured by folding an end portion 15 of first end 14 over and stitching 17 the end portion to the band member 12, thus forming a loop for holding the rings 18 in position. Although the above represents a preferred embodiment, the rings may be secured by any suitable means.

In order that the band member 12 may accommodate various arm sizes, the length of the band member and the securing means should be such as to allow the ends of the band member 12 to be connected together at various points. The fastening rings 18, previously described, readily perform the latter function by allowing the second end 16 of the band member 12 to be pulled through the fastening rings 18 until the desired loop size is created from the band member 12.

A first strap member 20 has a first end 22 that is secured to the band member by means of permanent stitching or the like. The first strap member 20 is secured to the band member 12 at a position along the length of the band 12 and, as can be seen in FIG. 2, is preferably located at a position closer to the first end 14 than the second end 16 of the band member 12. The first strap member 20, like the band member 12, is fabricated from a non-stretchable material and, preferably, from a cloth belt-like fabric.

With reference to FIG. 2, it can be seen that the first strap member 20 has a free end 24 which extends away from the band member 12 when the training aid is laid out flat. A pair of "D" rings 26 are secured to the first strap member 20 at its free end 24. The "D" rings 26, which are preferably formed from metal or a similar high strength material, may be secured to the first strap member 20 by any suitable conventional means, such as being retained in a loop formed on the free end 24.

The shooting aid further includes a second strap member 30 having a first free end 32 and a second free end 34 which is formed into a loop 40. The loop 40 is configured so as to allow it to be placed over the thumb of the player's hand. The free end 32 of the second strap member 30 is intended to be threaded through "D" rings 26 in such a manner, whereby the length of the second strap member 30, as measured from the loop 40 to the "D" rings 26, may be adjusted by pulling the free end 32 which projects beyond the "D" rings 26. Additionally, it is intended that the "D" rings 26 hold the second strap member 30 in position at the desired length. The second strap member 30, like the first strap member 20 and band member 12, is preferably fabricated of a non-stretchable material.

Although band member 12, strap member 20, and second strap member 30 are disclosed in the preferred embodiment as being fabricated from non-stretchable material, it should be appreciated that stretchable materials could be incorporated into alternate embodiments of the invention.

Figure 3:
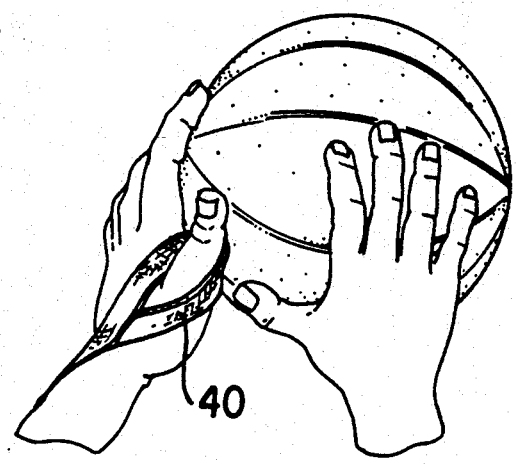
FIG. 3 is a fragmentary perspective view of the training and shooting aid as it appears when serving to pull the player's thumb upward, with the player's guide and shooting hands being shown holding a basketball.

The training and shooting aid is intended to be utilized by a player manually placing the band member 12 around his guide arm. As is apparent in FIG. 1, the band member 12 is intended to be located slightly above the player's elbow 52. The band member 12 is adapted to be snugly but comfortably secured around the player's arm. This is accomplished by threading the second end 16 of the belt member 12 through the fastening rings 18 in a manner such that the second end 16 of the belt member 12 may be pulled to securely adjust the band member 12 about the user's arm, while allowing the fastening rings 18 to hold the belt member 12 in a desired position about the user's arm. The player then places the loop 40 of the second strap member 30 over the thumb of his guide hand and wraps the second strap member 30 diagonally across the front of the guide hand and forearm to the outer portion of the arm proximate the elbow whereupon the player threads the free end 32 of second strap member 30 through the "D" rings 26 located slightly below the elbow 52. At this point the first strap member 20 continues to wrap around the user's arm to the first end 22 that is attached to the band member. In use, the connection of the first end 22 of the first strap member 20 to the band member 12 will preferably be at a position approximately opposite the elbow in the bend of a user's arm 54. The free end 32 which projects from the "D" rings 26 is then manually pulled upon by the player with his opposite hand so as to pull the thumb within the loop 40 upwardly and outwardly toward the top of the arm and toward the elbow, as depicted in FIG. 3. With the second strap member 30 so tightened, the band member 12 is prevented from sliding down the arm toward the hand by means of the band member 12 being snugly attached above the elbow. It is apparent of course that the free end 32 of the second strap member 30 may be threaded through the "D" rings 26 prior to the device being applied to the player's arm.

The training and shooting aid of the present invention, when properly assembled upon the guide arm of a basketball player, does not allow the guide hand to rotate inwardly toward the basketball at the beginning of a shot. By inhibiting rotation of the guide hand toward the basketball, due to the hand being pulled back toward the elbow, the training and shooting aid prevents the guide hand from being relied upon to propel the ball. Additionally, the invention serves to effectively pull the thumb of the guide hand back toward the elbow, thereby eliminating the common tendency to utilize the thumb of the guide hand to propel the basketball. The subject invention thus insures that the shooting arm will be utilized by the player as the exclusive source of power for propelling the ball so as to obtain the desired intended trajectory without interfering forces form the guide arm and hand.

Although the invention has been illustrated and described in detail in connection with a preferred embodiment, it is to be understood that various modifications, additions, and changes may be made to the invention by one skilled in the art without departing from the spirit and scope of the invention as embodied in the appended claims.

What is claimed is:

1. A training and shooting aid for basketball players comprising band means for attachment to the guide arm of a basketball player at a position above the player's elbow;

thumb-engaging means; and a non-stretchable strap member connecting said band means and said thumb-engaging means; wherein, said thumb-engaging means is adapted to be secured upon the thumb of the guide hand of said player, such that the length of said strap member with respect to said thumb is pulled upwardly toward said elbow and retained in said upward position.

2. The training and shooting aid recited in claim 1, wherein said band means comprises a single band member having first and second ends, and securing means associated with said band member for allowing said band member to be adjustably secured around the guide arm of a basketball player, therefore allowing said band member to encircle the guide arm above the player's elbow.

3. The training and shooting aid recited in claim 2, wherein said securing means includes a pair of fastening rings attached to said first end of said band member through which the second end of said band member may be threaded.

4. The training and shooting aid recited in claim 1, wherein said band member consists essentially of a single band member having first and second ends, and further including a securing means associated with said band member for allowing said band member to be adjustably secured around the guide arm of a basketball player, therefore allowing said band member to encircle the guide arm above the player's elbow.

5. The training and shooting aid recited in claim 1, wherein said band means is fabricated of a non-stretchable material.

6. A training and shooting aid recited in claim 1, wherein said band means is adapted to be secured around arms of various sizes.

7. The training and shooting aid of claim 1, wherein said strap member includes said thumb-engaging means at a first end.

8. The training and shooting aid of claim 7, wherein receiving means are provided for connecting a free second end of said strap member to said band means.

9. The training and shooting aid recited in claim 8, wherein said receiving means is a pair of rings, said free second end of said strap member is adapted to be threaded through said rings whereby said thumb is pulled upwardly by said player pulling upon said second free end.

10. The training and shooting aid recited in claim 9, wherein said rings are D-rings.

11. The training and shooting aid recited in claim 7, wherein said thumb-engaging means is a loop member, said loop member being adapted to receive said thumb.

12. A training and shooting aid for basketball players comprising a band member, said band member having free ends, securing means provided on one of said free ends of said band member whereby said band member may be adjustably secured around the guide arm of a basketball player, said band member being adapted to snugly encircle said arm slightly above the elbow, a separable primary non-stretchable strap member having a first end terminating in a loop and having a second free end, at least a pair of ring members provided on a second strap member extending from the said band member, said ring members provided for receiving said second free end of said primary strap, said loop being adapted to be placed upon the thumb of the guide hand of the player, said second free end of said primary strap member being adapted to be threaded through said ring members whereby the length of said primary strap member with respect to said band member may be adjusted so that said thumb is pulled upward toward said elbow and positively retained in said position.

13. The training and shooting aid recited in claim 12, wherein said securing means includes a pair of fastening rings attached to said one of said free ends of said band member to which the other of said free ends may be threaded.

14. The training and shooting aid recited in claim 12, wherein said ring members are metal "D" rings, said "D" rings being secured at an end of said strap member.

15. A method of using a training and shooting aid for basketball players characterized by a band member having first and second ends, securing means associated with said first end, a separable strap member having a loop at one end and a second free end, and a pair of ring members associated with said band member, said method comprising the steps of:

a) manually placing said band member on the guide arm of a player;
b) securing said first and second ends of said band member together by means of said securing means;
c) positioning said band member around said arm so that the band member snugly encircles said player's guide arm above the elbow;
d) placing said loop of said separable strap member over the thumb of said player's guide hand;
e) threading said second free end of said separable strap member through said ring member; and
f) manually pulling upon said second free end of said separable strap member which projects from said ring members in order to tighten said strap member, whereby said thumb is pulled upwardly toward said elbow.

* * * * *